United States Patent [19]

Schmid

[11] 4,447,085

[45] May 8, 1984

[54] GRAPPLE ASSEMBLY

[75] Inventor: Frederick L. Schmid, San Francisco, Calif.

[73] Assignee: The United States of America as represented by the United States Department of Energy, Washington, D.C.

[21] Appl. No.: 384,307

[22] Filed: Jun. 2, 1982

[51] Int. Cl.[3] ..... B66C 1/42

[52] U.S. Cl. ..... 294/97; 414/753

[58] Field of Search ..... 294/97, 95, 94, 115, 294/116; 414/753, 416; 198/694, 696

[56] References Cited

U.S. PATENT DOCUMENTS

| | | | |
|---|---|---|---|
| 2,832,633 | 4/1958 | Compson | 294/97 |
| 3,310,337 | 3/1967 | Riemenschneider | 294/97 |

*Primary Examiner*—James B. Marbert

*Attorney, Agent, or Firm*—Edwin D. Grant; Stephen D. Hamel; Michael F. Esposito

[57] ABSTRACT

A grapple includes a pivotal L-shaped catch and a lever arranged to move the catch to an object-releasing position when the lever engages the object.

7 Claims, 8 Drawing Figures

GRAPPLE ASSEMBLY

BACKGROUND OF THE INVENTION

This invention, which was made under a contract with the United States Department of Energy, relates to a grapple that can be coupled to and released from an object by merely changing the position of the grapple relative to the object.

In many industrial operations, separate mechanical or electrical actuating systems are installed on hoists or other transporters to control the position of connecting elements such as catches from a point remote therefrom. This invention eliminates the need for such expensive remote control actuating systems, since it provides an uncomplicated and reliable grapple assembly that can be placed in object-holding and object-releasing positions simply by changing the position of a moving means (such as a hoist) on which the assembly is mounted.

SUMMARY OF THE INVENTION

The object of the invention is to provide a connecting means which can be attached to and detached from a load by changing the position of the former relative to the latter.

This object is achieved by a preferred embodiment of the invention comprising a plurality of L-shaped catches respectively pivotally mounted on brackets that are evenly spaced about a center post. Each catch is connected by a link to a lever having one of its ends pivotally connected to the center post, and movement of the center post toward an object engages each lever with the object and swings the catches from a holding position to a release position.

DETAILED DESCRIPTION OF THE PREFERRED EMBODIMENT OF THE INVENTION

Figure 1:
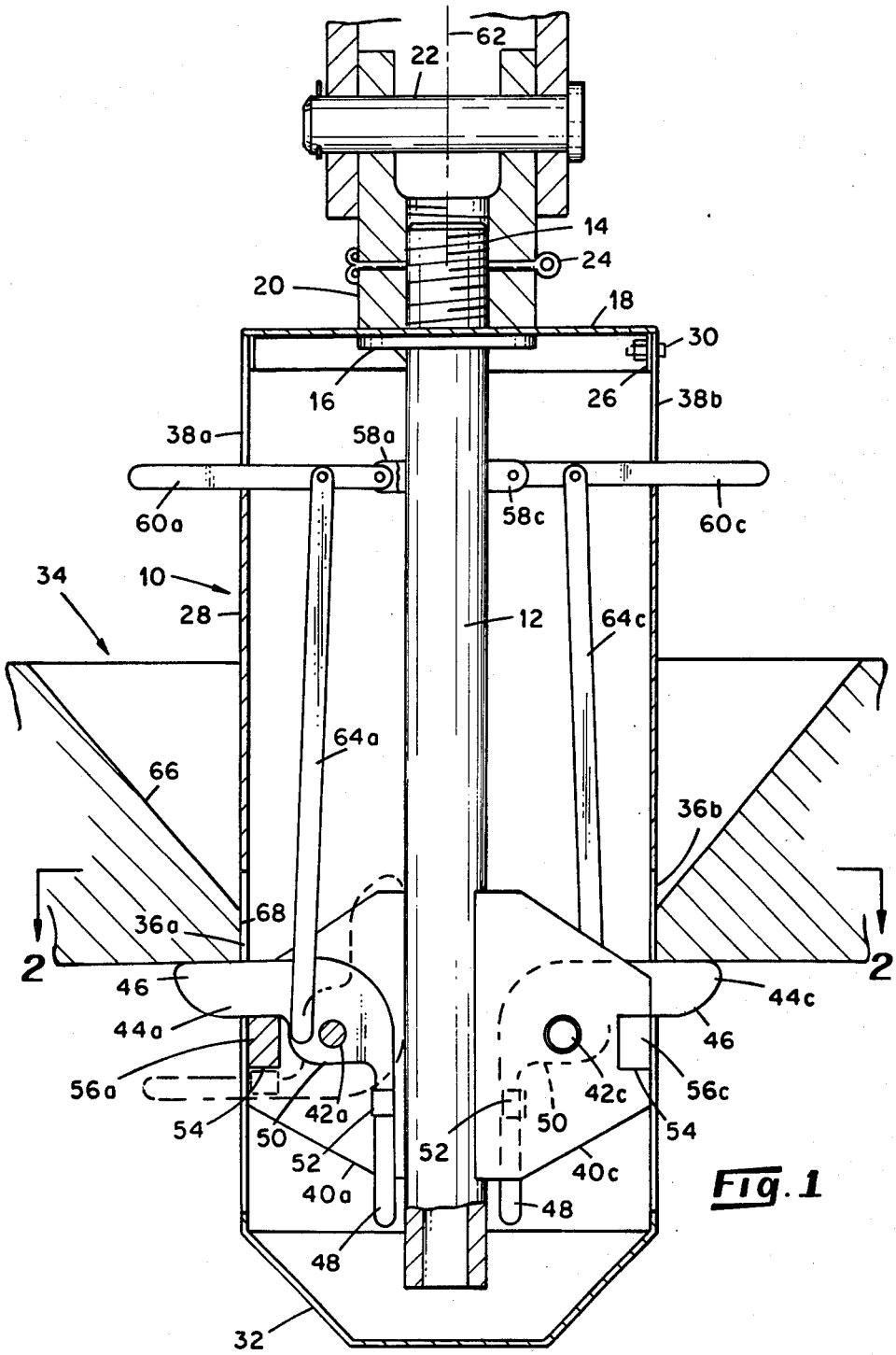
FIG. 1 is a sectional view of the preferred embodiment of the invention.

In FIG. 1, reference number 10 generally designates a grapple comprising an elongate, vertically extending support 12 in the form of a tubular post provided with a thread 14 at its upper end. A housing support washer 16 is placed on support 12 and fixed in position thereon at the bottom of thread 14 by welding. A centrally apertured disk 18 is also fitted around the upper end of support 12 and rests on, and projects radially outward from, washer 16. Disposed above disk 18 and threadedly engaged with support 12 is a clevis 20 provided with an attachment pin 22 and held in place by a cotter pin 24.

Figure 2:
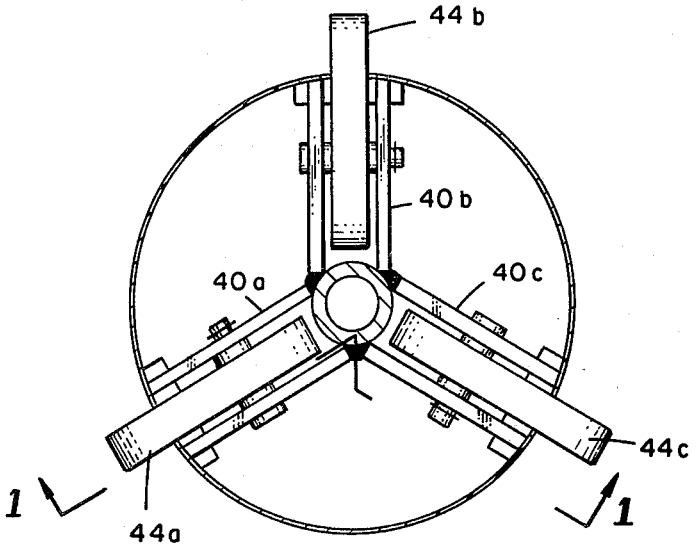
FIG. 2 is another sectional view of the preferred embodiment of the invention, taken along the plane represented by the line designated 2—2 in FIG. 1 and in the direction indicated by arrows associated with the line.

A cylindrical skirt 26 is fixedly attached to and projects downwardly from the edge portion of disk 18, and a cylindrical, tubular housing 28 is connected to the skirt by bolts 30 and projects downwardly to a point below the lower end of support 12, the lower end of the housing being formed with an end cover 32. It should be noted that the sectional view shown in FIG. 1 is taken along the planes represented by the line designated 1—1 in FIG. 2, and FIG. 2 is taken along the plane designated 2—2 in FIG. 1. A ring 34 is shown in cross section in FIG. 1, and also illustrated in FIG. 1 and designated by reference numbers **36*a*,36*b* therein are two of three identical vertically extending slots which are formed in the lower portion of housing 28 and evenly spaced apart about its periphery. Three additional identical slots (two of which are illustrated in FIG. 1 and designated 38*a*,38*b*) are also formed in the upper portion of housing 28** in vertical alignment with the three slots at the bottom of the housing.

Respectively aligned with the three slots in the lower portion of housing 28 are three brackets **40*a*–40*c* each having two arms which are disposed in parallel, spaced relation to each other and which project substantially radially outward from support 12 and are welded thereto. A respective one of three pivot pins 42*a*–42*c* extends through apertures formed in the middle of the two arms of each bracket 40*a*–40*c* and through the middle portion of a catch disposed between the arms and generally designated by one of the reference numbers 44*a*–44*c*. Each catch 44*a*–44*c* has first and second arms 46,48 disposed in perpendicular relation to each other and each catch also includes an enlarged hub portion 50, which for the purpose of interpretation of certain claims appended hereto is to be considered as consisting of two enlarged parts of the arms 46,48. A magnet 52 is attached to each arm 48 for a purpose that will be explained later. A notch 54 is formed in the two arms of each bracket 40*a*–40*c* at the edges thereof remote from support 12, and a stop element 56*a*–56*c* in the form of a bar conformably fits in the notches of each bracket and projects laterally from opposite sides of the bracket, at which points the ends of the stop element are welded to said sides. In the position of the described components that is illustrated in FIG. 1, first arm 46 of each catch 44*a*–44*c* abuts the upper surface of the stop element 56** attached to the bracket associated with the catch.

Three mounting lugs **58*a*–58*c* (only two of which are illustrated, in FIG. 1, and each having parallel support arms) are welded to the upper end of support 12 and respectively vertically aligned with brackets 40*a*–40*c*. One end of a lever 60*a*–60*c* (again only two are illustrated, also in FIG. 1) is pivotally connected to each mounting lug between the arms thereof and projects radially outward from support 12 so that it is aligned with a respective one of the catches 44*a*–44*c* in a plane which includes the longitudinal axis 62 of the support. A link 64*a*–64*c* is connected at one end thereof to the enlarged portion 50 of the first arm 46** of each catch and at its other end to the lever aligned with the catch.

OPERATION OF THE PREFERRED EMBODIMENT

Figure 3:
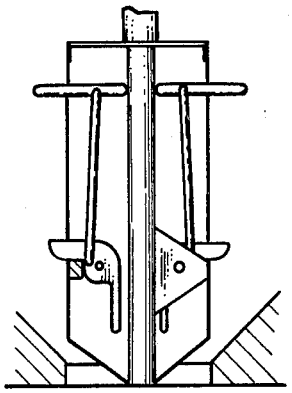
FIGS. 3–8 are simplified sectional view of the grapple illustrated in FIGS. 1 and 2, the views showing different positions of components as the grapple is being connected to and detached from an object.
Figure 4:
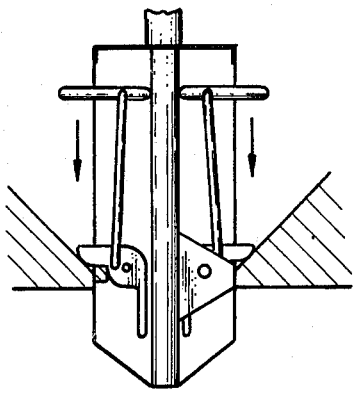
Figure 5:
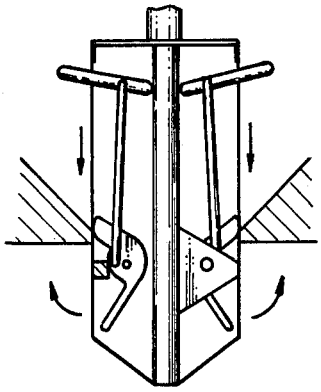
Figure 6:
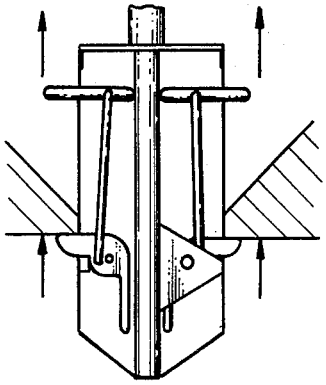

The ring 34 mentioned hereinbefore is connected to an object (not illustrated) to be moved by means of grapple 10, and the aperture therein comprises a conical counterbore 66 and a lower portion 68 sized to slidably receive housing 28 of the grapple. FIG. 3 illustrates the positions of components of the grapple before the grapple is lowered into the aperture in ring 34 by the hoist or other lifting means connected to clevis 20. In FIG. 4, grapple 10 is illustrated in a lowered position within ring 34 wherein the rounded ends of first arms 46 of catches 44a–44c have engaged the counterbore 66 in ring 34, and FIG. 5 illustrates the grapple after it has been lowered slightly farther into the ring and catches 44a–44c have been rotated by sliding downward on the counterbore surface and have then passed through the lower portion 68 of the aperture in the ring. Rotation of catches 44a–44c causes links 64a–64c to raise levers 60a–60b, but movement of the latter is not important at this point in the operation of the grapple. After the free ends of first arms 46 of catches 44a–44c disengage from the lower portion of the aperture in the ring, the turning moments exerted against the catches and the levers cause the catches to rotate back into abutment with stop elements 56a–56c as illustrated in FIG. 6. It will be manifest that upward movement of the grapple after its catches have been placed in the position illustrated in FIG. 6 lifts ring 34 and the object attached thereto.

Figure 7:
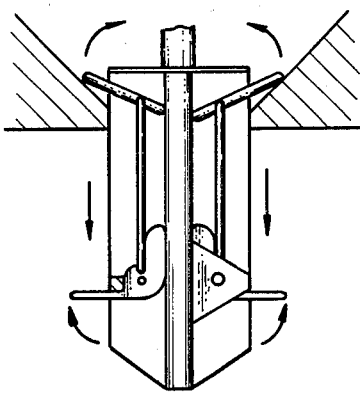
Figure 8:
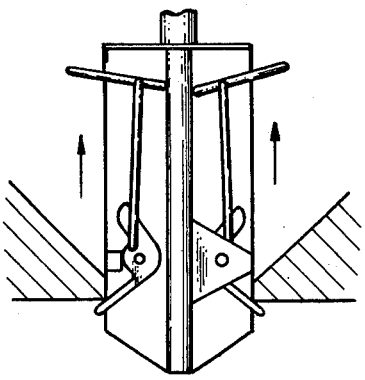

Release of grapple 10 from ring 34 is effected by lowering the grapple to the position illustrated in FIG. 7 wherein levers 60a–60c engage the conical counterbore 66 in the ring and pivot upwardly toward disk 18. Catches 44a–44c are simultaneously rotated by links 64a–64c approximately 90° to a second object-releasing position wherein the first arm 46 of each catch is moved upwardly away from its associated stop element 56a–56c and the second arm 48 of each catch is moved into abutment with the lower surface of said stop element and projects through a respective one of the slots 36a–36c in the lower portion of housing 28 in perpendicular relation relative to the longitudinal axis 62 of support 12. Catches 44a–44c are held in the FIG. 7 position by attraction between the magnets 52 on second arms 48 and the stop elements 56a–56c until grapple 10 is raised to the position illustrated in FIG. 8, wherein the second arms engage the lower surface of ring 34 and pivot back to the position illustrated in FIG. 3.

It will be obvious that modifications can be made in the arrangement of the grapple which has been described without departing from the scope of the invention, which should be considered as being limited only by the terms of the claims appended hereto. For example, spring-loaded ball detents which are respectively mounted on brackets 40a–40c and positionable in depressions formed in catches 44a–44c can be substituted for magnets 52 to releasably hold the catches in their first object-holding and second object-releasing positions.

What is claimed is:

1. A grapple comprising:

an elongate support;

a stop element fixedly connected to said support and spaced from its longitudinal axis, said stop element having first and second abutment surfaces which are spaced apart from each other axially of said support and a side surface which is remote from said support;

a catch having first and second arms disposed in substantially perpendicular relation to each other, said catch being connected at the middle portion thereof to said support for rotation about an axis which is transverse to the longitudinal axis of said support and which is located between said longitudinal axis and said stop element, said catch being swingable between (1) a first object-holding position wherein said first arm abuts said first abutment surface of said stop element and is disposed substantially perpendicular to the longitudinal axis of said support and said second arm is disposed adjacent said support and substantially parallel with its longitudinal axis, and (2) a second object-releasing position wherein said first arm is spaced from said stop element and said second arm is disposed adjacent said second abutment surface of said stop element and substantially perpendicular to the longitudinal axis of said support;

a lever connected at one end thereof to said support for rotation about an axis which is transverse to the longitudinal axis of said support, said lever being spaced from said catch and aligned therewith in a plane including the longitudinal axis of said support, said lever being swingable between (1) a first position wherein it is disposed substantially perpendicular to the longitudinal axis of said support and (2) a second position wherein it is inclined relative to the longitudinal axis of said support; and a link connected at one end thereof to the first arm of said catch and connected at the other end thereof to said lever so that said catch and said lever jointly move between said first and second positions thereof.

2. A grapple comprising:

an elongate support having a vertically extending longitudinal axis and upper and lower ends;

a stop element fixedly carried by said support in spaced relation to the longitudinal axis thereof and having upper and lower abutment surfaces and a side surface which is remote from the longitudinal axis of said support, a catch having first and second arms disposed in substantially perpendicular relation to each other, said catch being connected at the middle portion thereof to said support for rotation about a substantially horizontal axis located between said stop element and the longitudinal axis of said support, said catch being swingable between (1) a first object-holding position wherein said first arm abuts the upper abutment surface of said stop element and projects radially outward from the side of said stop element remote from the longitudinal axis of said support, and said second arm projects downwardly from said stop element in substantially parallel relation with the longitudinal axis of said support, and (2) a second object-releasing position wherein said first arm is spaced upwardly from said stop element and said second arm is disposed adjacent the lower abutment surface of said stop element and projects radially outward from the side of said stop element remote from the longitudinal axis of said support;

a lever connected at one end thereof to said support for rotation about a substantially horizontal axis, said lever being spaced above said catch and aligned therewith in a plane including the longitudinal axis of said support, said lever being swingable between (1) a first position wherein it is substantially horizontal and (2) a second position wherein it is tilted upwardly; and a link connected at one end thereof to the first arm of said catch and connected at the other end thereof to said lever so that said catch and said lever jointly move between said first and second positions thereof.

3. The grapple of claim 2 wherein said support is a cylindrical post.

4. The grapple of claim 3 including a cylindrical, tubular housing fixedly connected to said post and concentrically spaced thereabout, a pair of openings being formed in the wall of said housing, said lever extending through one of said openings when it is in both of said first and second positions thereof, said first arm of said catch extending through the other of said openings when said catch is in said first position thereof and said first arm being retracted inside said housing when said catch is in said second position thereof.

5. The grapple of claim 4 including:

a bracket fixedly connected to said post and projecting radially outward therefrom; and a pin carried by said bracket for pivotally mounting said catch thereon.

6. The grapple of claim 5 including a magnet secured to said second arm of said catch for holding said second arm adjacent the lower surface of said stop element when said catch is in said second position thereof.

7. The grapple of claim 6 including a plurality of stop elementd, catches, levers and links constructed and arranged as defined in claim 1 and respectively associated in units evenly spaced apart from one another about said post.

* * * * *